United States Patent [19]

Larizza

[11] Patent Number: 4,811,837

[45] Date of Patent: Mar. 14, 1989

[54] PRODUCE SHIPMENT AND SEPARABLE DISTRIBUTION AND DISPLAY CARTON

[75] Inventor: Edward P. Larizza, Chapaqua, N.Y.

[73] Assignee: United Brands Company, Cincinnati, Ohio

[21] Appl. No.: 30,218

[22] Filed: Mar. 25, 1987

[51] Int. Cl.[4] ..... B65D 17/00

[52] U.S. Cl. ..... 206/45.11; 53/492; 206/44 R; 206/459; 206/499; 206/602; 229/23 R

[58] Field of Search ..... 53/171,173, 381 A, 381 R, 53/382, 492; 206/44 R, 44 K, 45.11, 45.12, 459, 499, 602; 229/23 A, 23 R, 23 BT, 120.32, 120.37, 901

[56] References Cited

U.S. PATENT DOCUMENTS

| | | | |
|---|---|---|---|
| 1,866,323 | 7/1932 | Russell . | |
| 1,988,104 | 1/1935 | Andrews . | |
| 2,082,677 | 6/1937 | Belsinger . | |
| 2,098,090 | 11/1937 | Ford . | |
| 2,141,743 | 12/1938 | Ethridge . | |
| 2,146,420 | 2/1939 | Davidson . | |
| 2,446,366 | 8/1948 | Epps . | |
| 2,654,469 | 10/1953 | Fulmer et al. . | |
| 2,660,300 | 11/1953 | Pauls . | |
| 2,709,519 | 5/1955 | Cushman . | |
| 2,729,885 | 1/1956 | Wahl | 53/381 A |
| 2,947,637 | 8/1960 | Fobiano . | |
| 3,043,490 | 7/1962 | Burnett . | |
| 3,090,483 | 5/1963 | Altree et al. . | |
| 3,139,979 | 7/1964 | Russell . | |
| 3,168,234 | 2/1965 | Bartz . | |
| 3,252,646 | 5/1966 | Rockefeller . | |
| 3,447,733 | 6/1969 | Smith et al. . | |
| 3,664,494 | 5/1972 | Mergens | 206/44 R |
| 3,732,976 | 5/1973 | Bessett et al. | 206/499 |
| 3,782,538 | 1/1974 | Kinderman . | |
| 3,858,717 | 1/1975 | Peters | 206/459 |
| 3,884,348 | 5/1975 | Ross . | |
| 4,113,100 | 9/1978 | Soja et al. . | |
| 4,421,229 | 12/1983 | Pan et al. . | |
| 4,444,354 | 4/1984 | Staelgraeve | 206/459 |
| 4,530,459 | 7/1985 | Maroszek | 229/23 A |

FOREIGN PATENT DOCUMENTS

| | | | |
|---|---|---|---|
| 2003118 | 3/1979 | United Kingdom | 206/459 |

*Primary Examiner*—Jimmy G. Foster

[57] ABSTRACT

A carton system for transport, distribution and point-of-sale display of produce consists of a regular corrugated carton and a pair of open produce trays constructed for stacking within the carton for transport. The carton is separable, e.g., at the distribution site, into a pair of carton segments, each sized to fit over a single tray to form a distribution package. The carton segments are also sized to be removed from the trays, e.g., by a retailer, inverted, and the trays placed within the carton segments for point-of-sale display. In one embodiment, the carton segments are marked to be legible in both distribution and point-of-sale arrangement. A method of transport, distribution and point-of-sale display of produce, especially single finger bananas, is also described.

4 Claims, 2 Drawing Sheets

PRODUCE SHIPMENT AND SEPARABLE DISTRIBUTION AND DISPLAY CARTON

The invention relates to cartons for produce which is shipped from a packer to a distribution site, and from there to a retailer for point-of-sale display.

SUMMARY OF THE INVENTION

According to the invention, a carton system for transport, distribution and point-of-sale display of produce comprises a regular, corrugated carton having an upper horizontal panel, a lower horizontal panel, and sidewall panels extending between the upper and lower horizontal panels, and a pair of corrugated, open produce trays, having an inside divider, and sized and constructed to rest within the carton in stacked array. The carton is adapted for separation along a plane generally corresponding to the plane of intersection of the stacked trays therewithin into a pair of carton segments. Each carton segment is sized and constructed to fit snugly over a produce tray, with the horizontal panel of the carton segment disposed over the produce in the tray, and segments of the sidewall panels of the carton segment disposed closely about side surfaces of the tray to form a distribution package of a single produce-containing tray protected by a carton segment. Each produce tray is sized and constructed to fit snugly within a carton segment with the horizontal panel of the carton segment disposed beneath the produce tray, and segments of the sidewall panels of the carton segment disposed closely about side surfaces of the tray to form a display package of a single produce-containing tray, with the produce exposed for display, within a carton segment.

In preferred embodiments, the sidewall panel segments of the carton segments bear pairs of markings, a first the marking displayed in orientation for reading when the carton segment and tray are assembled for produce distribution, and a second marking displayed in orientation for reading when the carton segment and tray are assembled for produce display.

According to another aspect of the invention, a method for transport, distribution and point-of-sale display of produce comprises the steps of: packing produce in open produce trays, stacking first and second trays of packed produce in a regular, corrugated carton having an upper horizontal panel, a lower horizontal panel, and sidewall panels extending between the horizontal panels, the cartons sized and constructed to snugly receive the first and second trays therewithin, closing the carton and shipping the carton containing the produce to a distribution site, separating the carton into upper and lower carton segments along a plane generally corresponding to the plane of intersection of the trays stacked within the carton, separation of the carton segments and associated trays creating a first distribution package of the first produce tray within the upper carton segment, the horizontal panel of the segment disposed over the produce in the tray and segments of the sidewall panels disposed closely about side surfaces of the tray, removing the second produce tray from the lower carton segment, inverting the lower carton segment and covering a second produce tray with the lower carton segment to create a second distribution package, transporting a distribution package to a produce retail site, and removing the carton segment from the produce tray, inverting the carton segment, and placing a produce tray therewithin to create a point-of-sale produce display.

In preferred embodiments of the method, the sidewall panel segments of a carton segment bear pairs of markings, a first marking displayed in orientation for reading when the carton segment is assembled over a Produce tray for distribution, and a second marking displayed in orientation for reading when the produce tray is disposed in the carton segment for point-of-sale display, preferably the produce is single finger bananas.

Objectives of the invention include providing a carton system that can be used for transport of produce from the packer to point-of-sale display at a retailer; to provide a carton system useful for transport of bulk units of produce from a packer to the distributor and useful for distribution in smaller units to the retailer; to provide a carton with markings oriented for reading at all stages of product movement, i.e., shipment, distribution and point-of-sale display; and to provide a method of packaging produce that meets one or more of these objectives.

Other features and advantages of the invention will be apparent from the following description of a preferred embodiment, and from the claims.

PREFERRED EMBODIMENTS

We first briefly describe the drawings:

Drawings

Figure 1:
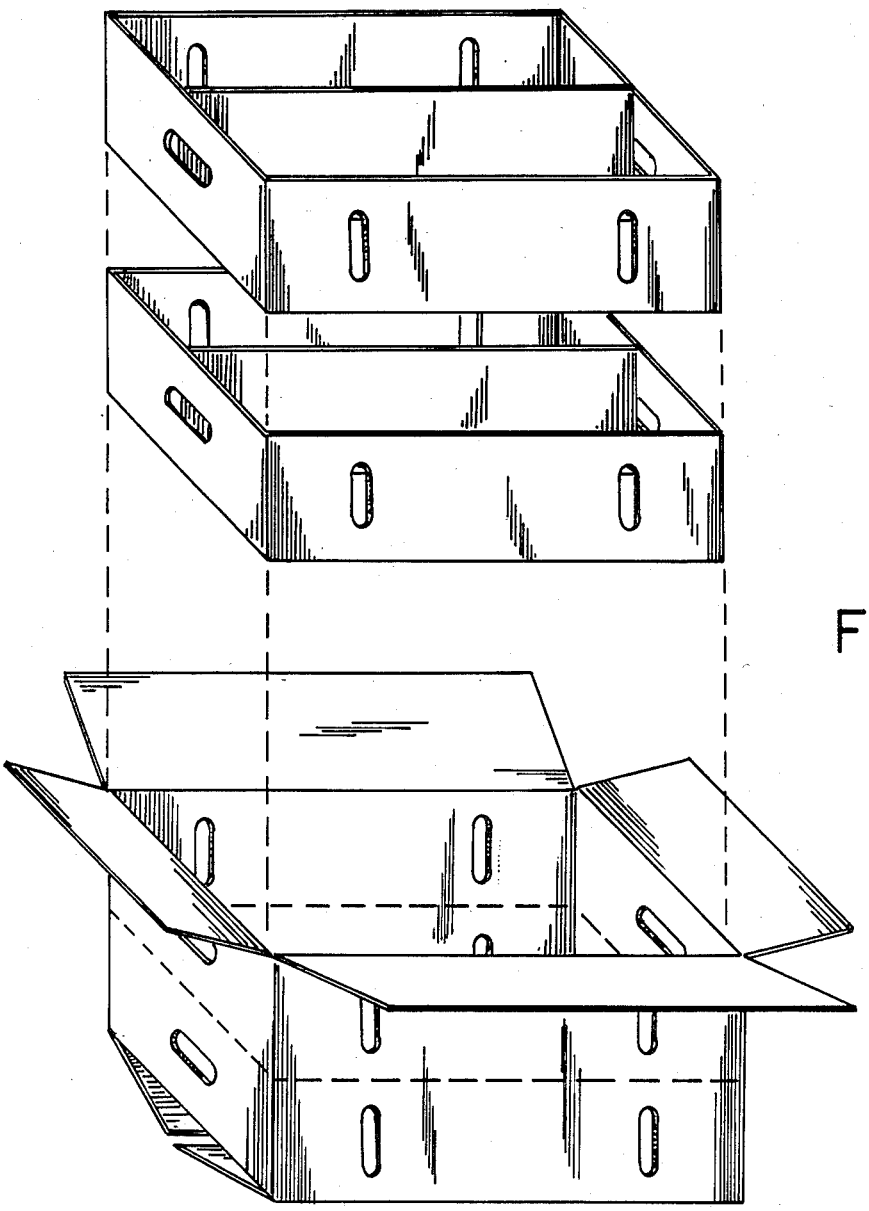
FIG. 1 is perspective view of the carton system of the invention.

Referring to FIG. 1, the carton system 10 of the invention consists of a regular corrugated carton 12 and a pair of open, corrugated produce trays 14. Each of the produce trays has an inside divider 18, and each is sized and constructed to receive, e.g., twenty pounds of single finger bananas. Stacked pairs of trays fit snugly within carton 10, and the trays and carton, with top and bottom flaps 20, 22 closed and sealed, form a unitized 40 lb. package 24 for shipment from the packing site to a distributor.

Figure 2:
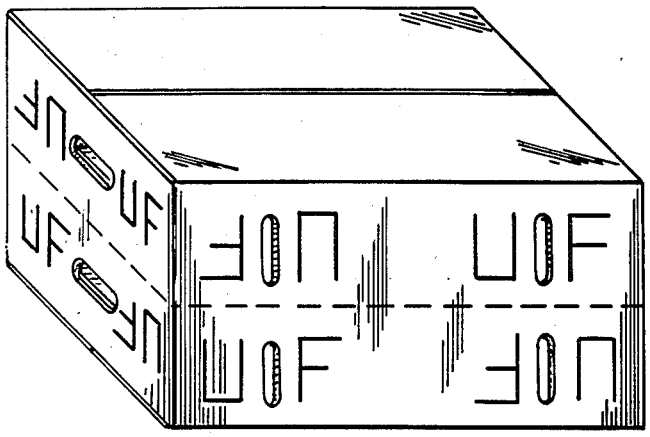
FIG. 2 is a similar view of the carton of FIG. 1 during shipment to a distributor.
Figure 3:
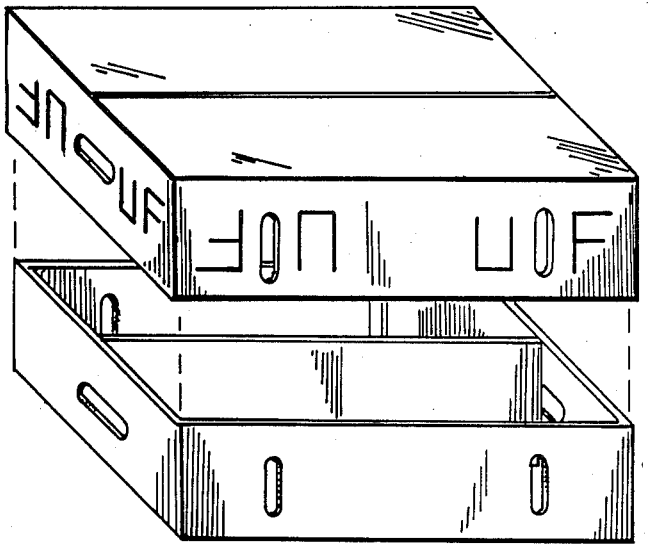
FIG. 3 is a similar view of a single produce tray and separated carton segment for distribution.

Referring to FIG. 2, the carton 10 has a upper horizontal panel 26, a lower horizontal panel 28, and side panels 30 extending therebetween. The carton is marked with a line 32 (or scored) generally along a plane corresponding to the plane of intersection of the trays within the carton, and the carton is separable along the line into a pair of carton segments 34. Each carton segment 34 is sized to fit snugly over a produce tray 14, with the horizontal panel covering the produce in the tray, and segments of the side wall panel disposed closely about the side surfaces 36 of the tray. In this manner, each 40 lb. shipping carton is separable into two 20-lb. units 38 suitable for distribution to retailers. Each distribution package 38 consists of a single produce-containing tray protected by an overlying carton segment. The sidewalls of the carton segment and the sides of the tray define corresponding openings 40 for ventilation, and hand openings 42 to facilitate handling of the distribution package.

Figure 5:
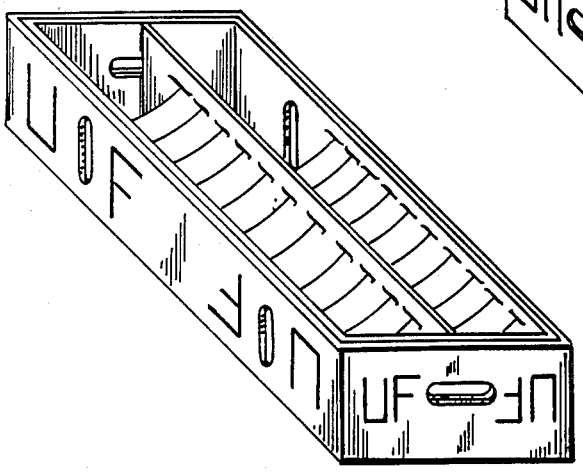
FIG. 5 is a perspective view of the carton segment and produce tray instead assembly as a point of sale display.

Referring to FIG. 5, for point-of-sale display 44 at the retail site, the carton segment 34 is sized and constructed to receive the open produce tray 14 therewithin, in nested relationship.

Figure 4:
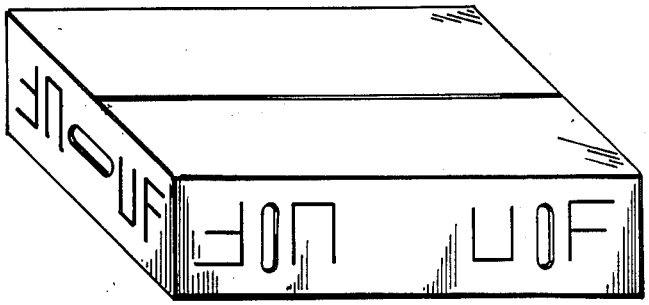
FIG. 4 is a similar view of the carton segment and tray assembly.

Referring to FIGS. 4 and 5, the side panels of the carton segments bear pairs of markings 46, 46', a first marking 46 of each pair oriented, as in FIG. 4, to be easily legible to the reader when the carton segment and tray are assembled for distribution. A second marking 46' of each pair is oriented, as in FIG. 5, to be legible to a reader when the carton segment and tray are assembled for point-of-sale retail display.

At the supply site, produce, e.g., single finger bananas 48 (FIG. 5), are packed in open, divided produce trays 14, typically 10 pounds per row, 20 lbs per tray. Pairs of trays are stacked in regular corrugated cartons 12, and the cartons closed and sealed to form sealed shipping units 24 of 40 lbs. each.

At the distribution site, the carton of the invention is separated, e.g., by cutting, along the line 32, which corresponds generally to the plane of intersection of the trays within the carton, into two carton segments.

Upon separation, the top tray remains covered by the upper carton segment, forming a distribution unit 38 of 20 lbs. of bananas. A second distribution unit is also formed by inverting the lower carton segment to form a cover over the bottom produce tray.

The distribution units 38 are transported to the retailer, who prepares his point-of-sale display 44 by removing the covering carton segment 34 from the produce tray 14, inverting it, and placing the tray within the carton segment in nested relationship.

As mentioned above, the pairs of markings on the sidewall panels of the cartons are oriented to provide easily legible markings upon both the distribution unit and the point-of-sale display.

Other embodiments are within the following claims.

What is claimed is:

1. A carton system for transport, distribution and point-of-sale display of produce, comprising:

a regular, corrugated carton having an upper horizontal panel, a lower horizontal panel, and sidewall panels extending between said upper and lower horizontal panels, and a pair of corrugated, open trays adapted for transport and display of loose produce, and sized and constructed to rest within said carton in stacked array, said carton adapted for separation along a plane generally corresponding to the plane of intersection of the stacked trays therewithin into a pair of carton segments, each said carton segment sized and constructed to fit snugly over a produce tray, with the horizontal panel of said carton segment disposed over said produce in said tray, and segments of the sidewall panels of said carton segment disposed closely about side surfaces of said tray to form a distribution package of a single produce-containing tray protected by a carton segment, each said produce tray sized and constructed to fit snugly within a said carton segment with the horizontal panel of said carton segment disposed beneath said produce tray, and segments of the sidewall panels of said carton segment disposed closely about side surfaces of said tray to form a display package of a single produce-containing tray, with the produce exposed for display, within a carton segment, each said produce tray of said carton system having a corresponding said carton segment having a horizontal panel, and the segments of the sidewall panels of each said carton segment bearing pairs of markings, a first marking of each said pair of markings displayed in orientation for reading when said carton segment and tray are assembled for produce distribution, and a second marking of each said pair of markings displayed in orientation for reading when said carton segment and tray are assembled for produce display.

2. A method for transport, distribution and point-of-sale display of produce, comprising the steps of:

packing produce in open produce trays, stacking first and second trays of packed produce in a regular, corrugated carton having an upper horizontal panel, a lower horizontal panel, and sidewall panels extending between said horizontal panels, said cartons sized and constructed to snugly receive said first and second trays therewithin, closing said carton and shipping said carton containing the produce to a distribution site, separating the carton into upper and lower carton segments along a plane generally corresponding to the plane of intersection of the trays stacked within the carton, separation of the carton segments and associated trays creating a first distribution package of the first produce tray within said upper carton segment, the horizontal panel of the segment disposed over the produce in the tray and segments of the sidewall panels disposed closely about side surfaces of the tray, removing the second produce tray from the lower carton segment, inverting said lower carton segment and covering a second produce tray with said lower carton segment to create a second distribution package, transporting a said distribution package to a produce retail site, and removing said carton segment from said produce tray, inverting said carton segment, and placing a produce tray therewithin to create a point-of-sale produce display.

3. The method of claim 2 wherein the sidewall panel segments of a said carton segment bear pairs of markings, a first said marking displayed in orientation for reading when the carton segment is assembled over a produce tray for distribution, and a second said marking displayed in orientation for reading when the produce tray is disposed in the carton segment for point-of-sale display.

4. The method of claim 2 wherein said produce is single finger bananas.

* * * * *

UNITED STATES PATENT AND TRADEMARK OFFICE

CERTIFICATE OF CORRECTION

PATENT NO. : 4,811,837

DATED : March 14, 1989

INVENTOR(S) : Edward P. Larizza

It is certified that error appears in the above-identified patent and that said Letters Patent is hereby corrected as shown below:

Column 2, Line 40: "instead" should be --in nested--.

Signed and Sealed this

Third Day of July, 1990

*Attest:*

*Attesting Officer*

HARRY F. MANBECK, JR.

*Commissioner of Patents and Trademarks*